US012064706B2

(12) United States Patent
Dill

(10) Patent No.: US 12,064,706 B2
(45) Date of Patent: Aug. 20, 2024

(54) PLAY EQUIPMENT, IN PARTICULAR FOR INTERIOR SPACES AND SMALL CHILDREN

(71) Applicant: Roman Dill, Berlin (DE)

(72) Inventor: Roman Dill, Berlin (DE)

( * ) Notice: Subject to any disclaimer, the term of this patent is extended or adjusted under 35 U.S.C. 154(b) by 0 days.

(21) Appl. No.: 15/735,648

(22) PCT Filed: Jul. 27, 2015

(86) PCT No.: PCT/DE2015/000380
§ 371 (c)(1),
(2) Date: Dec. 12, 2017

(87) PCT Pub. No.: WO2017/016531
PCT Pub. Date: Feb. 2, 2017

(65) Prior Publication Data

US 2018/0296936 A1 Oct. 18, 2018

(51) Int. Cl.
*A63H 33/00* (2006.01)
*A63H 33/04* (2006.01)
*A63H 33/08* (2006.01)

(52) U.S. Cl.
CPC ..... *A63H 33/008* (2013.01); *A63H 33/044* (2013.01); *A63H 33/084* (2013.01)

(58) Field of Classification Search
CPC .. A63H 33/008; A63H 33/044; A63H 33/084; A63H 33/04
USPC ..... 446/71, 108, 114, 486, 491
See application file for complete search history.

(56) References Cited

U.S. PATENT DOCUMENTS 2,392,024 A * 1/1946 Couri ..... A63H 9/00 446/374
2,950,120 A * 8/1960 Stewart ..... A63B 22/16 482/51
2,958,918 A * 11/1960 MacMillan ..... B28B 7/06 446/124

(Continued)

FOREIGN PATENT DOCUMENTS

DE 202006007048 U1 7/2006
KR 20140076086 A 6/2014
KR 20150145659 A 12/2015

OTHER PUBLICATIONS

KR 2006112163A Song K G 2 pages.*

*Primary Examiner* — Joseph B Baldori
(74) *Attorney, Agent, or Firm* — Laine IP Oy

(57) ABSTRACT

The invention relates to play equipment, in particular for inferior spaces and small children, comprising at least one portable play equipment, having a thin, stable core element which—viewed from the side—is arched and, in the direction of the arch, is flat and flexibly ductile at least in sections, and an at least one-piece protective sheath made from a material which is soft and flexible at least in sections, preferably from foam, which is fastened in contact at least to the arched outer surface, preferably to the arched outer surface and the arched inner surface of the core element and protrudes beyond the edges of the arched core element extending in the direction of the arch and beyond the two ends thereof, and forms a flexible protection buffer, which can be pressed in, against risk of injury, and/or an interior space protective buffer, the end sections of which each form at least one flexible clamping and/or protection lip of the play element in the direction of the arch.

7 Claims, 17 Drawing Sheets

(56) References Cited

U.S. PATENT DOCUMENTS 3,206,888 A * 9/1965 Litzka ..... A63H 33/08 446/107
3,211,160 A * 10/1965 Miller ..... A45D 8/36 132/275
3,236,007 A * 2/1966 Abeson ..... A63H 3/04 446/388
3,451,672 A * 6/1969 Kazdan ..... A63G 11/00 472/4
3,967,820 A * 7/1976 Harper ..... A63B 22/16 482/146
D264,987 S * 6/1982 Wise ..... D21/688
4,530,196 A * 7/1985 O'Bryan ..... E04B 1/02 52/DIG. 9
4,722,713 A * 2/1988 Williams ..... A63H 33/00 248/102
4,902,003 A * 2/1990 Buoni ..... A63B 23/0211 297/258.1
5,167,595 A 12/1992 Gleeson et al.
5,203,123 A * 4/1993 Travis ..... B24D 15/04 451/523
5,207,704 A * 5/1993 Shields ..... A47C 20/027 128/845
5,212,842 A * 5/1993 Glydon ..... A63H 33/082 428/44
5,330,399 A * 7/1994 Fan ..... A63B 22/16 403/291
5,577,466 A * 11/1996 Luxford ..... A01K 15/024 119/485
5,643,148 A * 7/1997 Naville ..... A43B 13/183 482/124
5,702,333 A * 12/1997 Waldron ..... A63B 23/0233 482/131
5,707,269 A * 1/1998 Murphy ..... A63H 33/048 446/268
5,715,854 A * 2/1998 Andrieux ..... E04H 15/001 52/592.1
5,722,446 A * 3/1998 Zheng ..... A63B 63/08 135/116
5,795,276 A * 8/1998 Almeda ..... A63B 21/00047 482/140
5,916,006 A * 6/1999 Ganson ..... A63H 33/00 446/107
5,927,296 A * 7/1999 Maturaporn ..... A45D 8/36 132/273
6,210,247 B1 * 4/2001 Rodriguez Ferre ..... A63B 9/00 446/476
6,237,610 B1 * 5/2001 Trevisan ..... A45D 8/36 132/273
6,470,896 B1 * 10/2002 Mensonides ..... A45D 8/36 132/200
6,564,390 B2 * 5/2003 Vernon ..... A41D 20/00 2/171
6,568,981 B1 * 5/2003 Chang ..... A63H 33/048 24/442
6,595,227 B2 * 7/2003 Le Gette ..... E04H 15/40 135/126
6,688,316 B1 * 2/2004 Klug ..... A45D 8/00 132/275
6,694,994 B1 * 2/2004 Zheng ..... A63H 33/008 135/117
6,860,786 B2 * 3/2005 Oren ..... B62B 9/26 446/227
7,322,910 B2 * 1/2008 Denoth ..... A63B 21/0004 482/142
7,836,906 B2 * 11/2010 Zheng ..... G06F 3/0221 135/91
7,854,671 B2 * 12/2010 Lalvani ..... A63B 41/08 473/607
7,887,079 B2 * 2/2011 Krafft ..... A63C 5/02 280/602
8,021,240 B2 * 9/2011 King ..... A63B 9/00 472/136
8,961,257 B2 * 2/2015 Connor ..... A63H 33/102 446/107
8,991,131 B1 * 3/2015 Lu ..... A63H 33/062 52/645
9,011,295 B2 * 4/2015 Orenstein ..... A63B 23/0458 482/52
9,163,393 B2 * 10/2015 Carroll ..... E04H 1/1244
9,327,205 B2 * 5/2016 Gongolas ..... A63H 33/00
9,636,600 B2 * 5/2017 Rudisill ..... A63H 33/046
9,763,507 B2 * 9/2017 Sze ..... A45D 8/36
11,235,191 B2 * 2/2022 Krull ..... A63B 23/1272
2002/0142894 A1 * 10/2002 Flynn ..... A63B 22/16 482/121
2003/0153243 A1 * 8/2003 Haas ..... A63H 33/048 446/85
2004/0065026 A1 * 4/2004 Wilson ..... E04B 7/102 52/80.1
2004/0132594 A1 * 7/2004 Verna ..... A63B 21/4039 482/140
2004/0266312 A1 * 12/2004 Oren ..... A47D 15/003 446/227
2005/0070199 A1 * 3/2005 Voves, III ..... F16B 2/248 446/124
2008/0289274 A1 * 11/2008 Dobbin ..... E04G 9/10 52/275
2009/0117311 A1 * 5/2009 Kuzmin ..... A63H 33/08 428/44
2010/0277944 A1 * 11/2010 Hurwitz ..... A41D 27/08 362/570
2014/0048094 A1 * 2/2014 Carriedo ..... A45D 8/00 132/210
2014/0256210 A1 9/2014 Johnson
2015/0072587 A1 * 3/2015 Ornstein ..... A63H 33/046 446/92
2015/0090288 A1 * 4/2015 Chudzik ..... A45D 8/34 132/273
2016/0192509 A1 * 6/2016 Hacking ..... H05K 5/0021 312/263
2019/0022541 A1 * 1/2019 Reese ..... A63H 33/006

* cited by examiner

A - A

A - A

A - A

A - A

A - A

A - A

A - A

A - A

PLAY EQUIPMENT, IN PARTICULAR FOR INTERIOR SPACES AND SMALL CHILDREN

FIELD

The invention relates to play equipment, in particular for interior spaces and small children, comprising at least one portable play element.

BACKGROUND

In contrast to the almost exclusively available range of small toys, there exists a need in childcare and therapeutic facilities as well as in household play areas for play equipment, in particular for interior spaces and small children, the size and dimensions of which satisfies the urge to move and need for a variety of gross motor activities in particular of small children, preferably in interior spaces. In addition, this play equipment must not pose any risk of injury while being handled, and has to offer space-saving storage capacity.

Therefore, the object of the present invention is to provide play equipment of the kind mentioned at the outset that satisfies the aforementioned requirements, and can at the same time be used and/or configured in a wide variety of ways for play.

SUMMARY

This object is achieved according to the invention by play equipment, in particular for interior spaces and small children, comprising at least one portable play element having a thin, stable core element which—viewed from the side—is arched and flat and flexibly formable at least in sections in the direction of the arch, and an at least one-piece protective sheath made out of a material which is soft and flexible at least in sections, preferably out of foam, which is fastened in contact at least with the arched outer surface, preferably with the arched outer surface and arched inner surface of the core element, and protrudes beyond the edges of the arched core element that extend in the direction of the arch and beyond the two ends thereof, and forms a telescoping, flexible protective buffer against the risk of injury and/or an interior space preserving buffer, the end sections of which each form at least one flexible clamping and/or protection lip of the play element in the direction of the arch.

The arched core element of the play element can be made out of a bendable material, preferably out of wood, plastic, composite material or light metal, preferably out of an aluminum alloy.

Viewed in the cross section of the core element perpendicular to the direction of the arch, the arched inner surface and arched outer surface of the arched core element of the play element can be both partially cylindrical and conical in shape.

The ends of the core elements along with the clamping and/or protection lips are preferably inwardly directed relative to the arched extension of the play element.

The ends of the arched play element can each be rounded to form the respective clamping and/or protection lip.

Viewed in cross section, the arched play element can be elliptical in design.

Viewed in the cross section of the arched play element, the two ends of the arched play element can each further be designed asymmetrically to each other to form the respective clamping and/or protection lip, wherein the arched inner surface and arched outer surface of the core element along with the outer surface and inner surface of the play element correspond to each other with a uniformly conical design. The arched core element of the play element can also be hollow in design at least in sections and—viewed from the side—be bent in a semicircular manner.

The arched core elements can also consist of identical square parts, which are rowed in the play element in the direction of the arch spaced uniformly apart, and connected to each other as one piece via flat webs, the ends of which engage the mutually facing surfaces of the corresponding square parts of the core element.

The portable, arched play element of the play equipment according to the invention can embody a ramp, balancing, ball catching, sitting, lying, rest and relaxation, play tunnel, outdoor gym, swing or play structure element, preferably a play tower element, to be positioned on the floor.

The protective sheath of the portable, arched play element can be made out of a washable material and/or an integral foam.

The protective sheath of the play element can have a two-piece design, such that an outer protective sheath part and inner protective sheath part are provided, which each are fastened in contact with the outer surface or inner surface of the arched core element so as to protrude beyond the latter, and at each end are separated by a groove extending outwardly from the core element in the direction of the arch, wherein an exterior and interior support and/or protection lip is formed at each end of the play element, which are spaced part from each other by a distance corresponding to the width of the respective groove.

The stable, arched core element of the play element preferably has a width ranging from 18 cm to 40 cm, a thickness ranging from 20 mm to 50 mm, and an arch length ranging from 100 cm to 200 cm.

The protective buffer against the risk of injury and/or interior space preserving buffer of the at least one portable play element can have a width ranging from 5 cm to 9 cm.

The portable play element can also be encased by an abutting, replaceable protective cover.

A plurality of the portable play elements of the play equipment according to the invention can preferably be detachably stacked one on top of the other to yield a play structure, in particular a play tower or crawl cavern, so that—viewed in the stacking direction—the protective sheath of each play element, which protrudes at least beyond the overhead edge of the respective core element extending in the direction of the arch, abuts positively with the respective arched inner surface against the arched outer surface of the lower play element adjacent in the stack, wherein the overhead edge of the core element of the—viewed in the stacking direction—respective lower play element forms a counter-bearing for the flexible clamping and/or protection lips on each of the two ends of the—viewed in the stacking direction—respective corresponding upper play element.

The adhesive friction between the arched inner surface and arched outer surface of the play elements respectively arranged one on top of the other in the stack combined with the counter-bearing effect described above between the overhead edge of the core element of the—viewed in the stacking direction—respective lower play element and each clamping and/or protection lip on the two ends of the—viewed in the stacking direction—respective corresponding upper play element provide for a special positive, high-strength connection between the stacked play elements. This prevents too strong a gripping of the play elements, and thereby increases the space for the play structure configured according to the invention. The extensively elastic adhesive friction of the protection and clamping lip ensures that the play elements can be taken apart easily, thereby preventing the latter from canting. At the same time, the protection buffer and/or preserving buffer of each of the stacked play elements provides an extremely high level of safety against any risk of injury should a play element tip over or fall down.

The arched inner and arched outer surfaces of the core element can be uniformly conical in design, such that a partially cylindrical play structure can be built in the stack of a plurality of arched play elements by uniformly pressing them in.

The arched inner surface and arched outer surface of the core element can also be configured with a conical formation that takes shape toward their ends, such that an organically curved play structure can be formed in the stack of a plurality of arched play elements by uniformly pressing them in. When stacking up to five arched play elements, the stability of the play structure is increased by shifting the center of gravity.

A plurality of the portable play elements can preferably also be detachably stacked one on top of the other to yield a play structure, in particular a play tower or crawl cavern, wherein the protective sheath of each play element consists of two parts, with an outer protective sheath part and an inner protective sheath part, which each project by the same distance s over the upper edge and lower edge of the core element, wherein a respective groove is formed, whose base is provided by the upper edge or lower edge of the core element, and whose width corresponds to the thickness of the core element, wherein the respective sections of the outer first protective sheath part along with the inner second protective sheath part projecting over the upper edge or lower edge of the core element each form internal and external support and protection lips, and wherein, of a respective two play elements adjacent in the stacking direction, the upper external support and protection lip of the outer first protective sheath part of the lower play element in the stacking direction is fit into the lower groove of the upper play element in the stacking direction, and engages the lower edge of the corresponding core element, while the lower, internal support and protection lip of the inner second protective sheath part of the upper play element in the stacking direction is fit into the upper groove of the lower play element in the stacking direction, and engages the upper edge of the corresponding core element.

The play equipment according to the invention promotes creativity in particular for small children with its diverse and variable playing and design options, and its size and weight configuration allow it to be used as an element for rest and physical relaxation, preferably in interior spaces, and easily transported, wherein the flexible foam protective buffer of the protective sheath fixedly abutting the core element of each portable play element virtually precludes the risk of injury when handling the play equipment according to the invention. For example, one or two small children can comfortably and safely swing in the arched play element, balance themselves therein or lie down and relax therein, wherein a child in the building or supine position can comfortably stretch out on the arched shape of the play element in the reversed position of the arched play element.

BRIEF DESCRIPTION OF THE DRAWINGS

The present invention will now be described with reference to the drawings. Shown therein are.

EMBODIMENTS

Figure 1A:
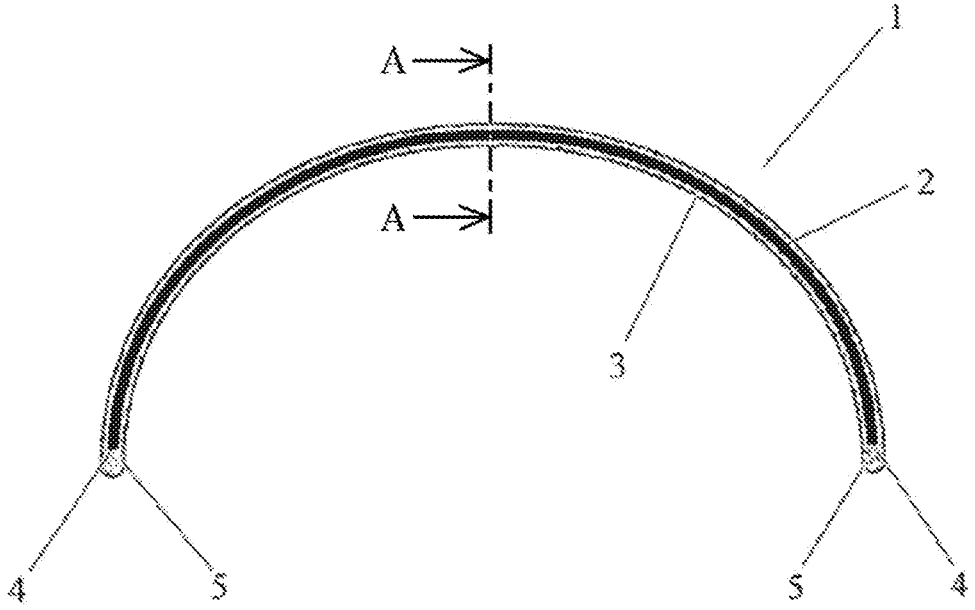
FIG. 1A to FIG. 1D are respective elevation views of a first to fourth embodiment of the play equipment according to the invention in the form of a portable, arched play element.

FIG. 1A shows an elevation view of a first embodiment of the play equipment according to the invention in the form of a portable, arched play element 1, which has an arched core element 2 that is flat over its entire arched shape, has the same comparatively slight thickness and is elastic. The play element 1 further has a one-piece protective sheath 3 made out of a material which is soft and flexible, preferably out of foam, which is fastened in contact with the arched outer surface and arched inner surface of the core element. The one-piece protective sheath 3 protrudes beyond the edges of the arched outer surface or the arched inner surface of the core element 2 that extend in the direction of the arch and beyond the two ends 4 thereof, and forms a telescoping, flexible protective buffer against the risk of injury and/or an interior space preserving buffer, the end sections of which each form at least one flexible clamping and/or protection lip 5 of the play element 1 in the direction of the arch.

Figure 1B:
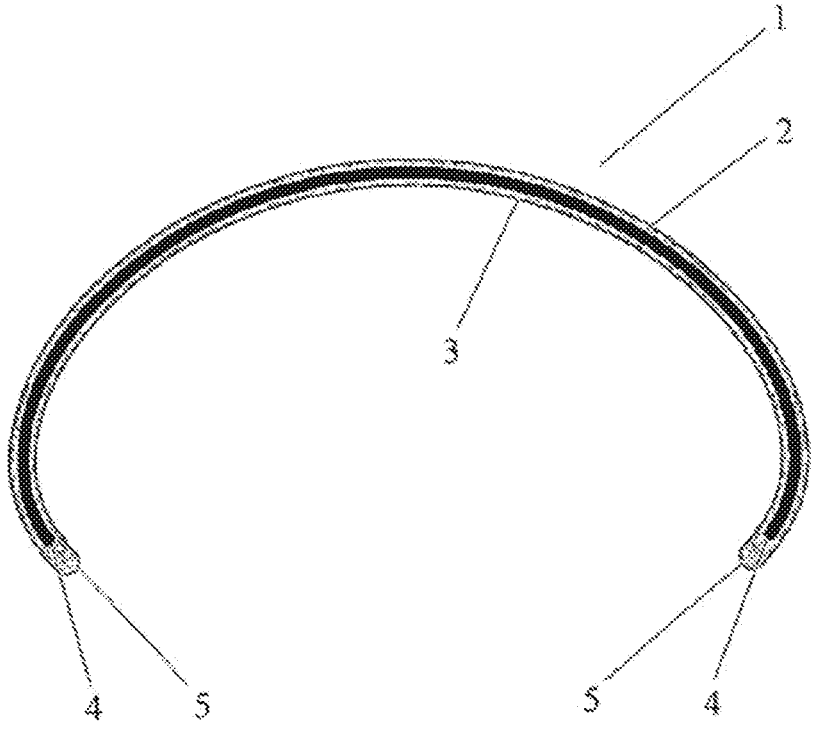

FIG. 1B shows an elevation view of a second embodiment of the arched play element 1, in which the ends 4 of the arched core element 2 along with the clamping and/or protection lips 5 are inwardly directed at the two ends of the play element 1 relative to the arched extension of the latter.

Figure 1C:
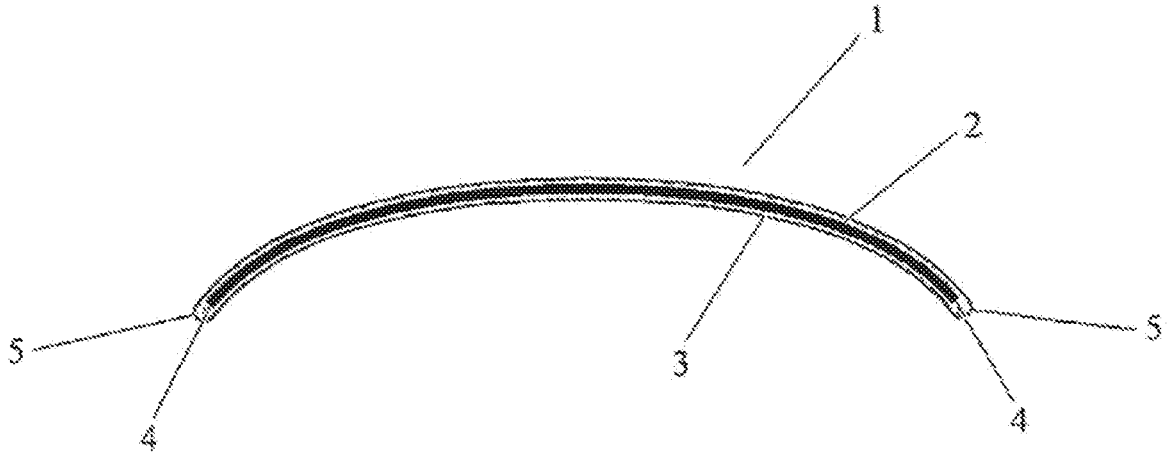
Figure 1D:
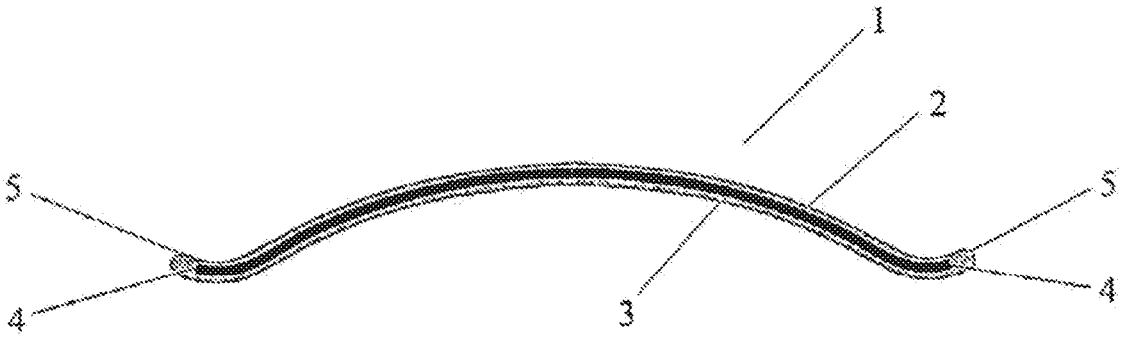

FIG. 1C and FIG. 1D show an elevation view of a third and fourth embodiment of the play element 1, wherein the arched shape of the play element 1 has a relatively flatly convex design in its third embodiment according to FIG. 1C or in its fourth embodiment according to FIG. 1D. As further evident from FIG. 1D, the two ends 4 of the core element 2 along with the clamping and protection lip 5 in the fourth embodiment are bent slightly upward at each end of the arched play element 1 relative to its arched extension.

Figure 2:
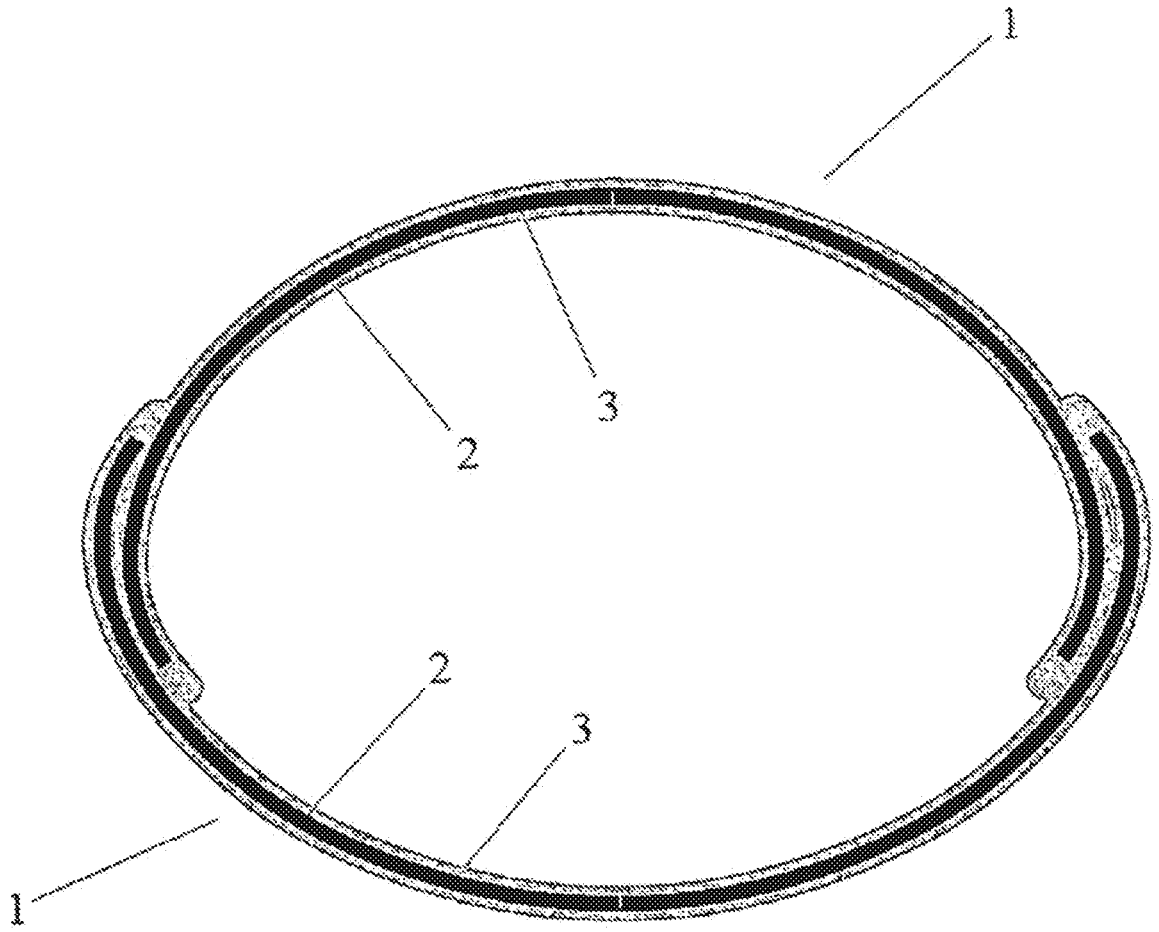
FIG. 2 is an elevation view of a play tunnel unit formed out of two arched play elements of the second embodiment.

As evident from FIG. 2, which shows an elevation view of a play tunnel unit comprised of two arched play elements 1 of the second embodiment, two such play elements 1 can be comfortably assembled in a mirror-inverted arrangement to the play tunnel unit by moving the flexible and elastic clamping and/or protection lips 5 slightly outward at the respective ends of the lower play element 1, and then telescoping the two play elements 1 into each other in a mirror-inverted manner, whereupon the latter spring back against the arched outer surface of the upper play element 1 when the clamping and/or protection lips 5 are released, so as to abut against and join the play tunnel unit.

Figure 3A:
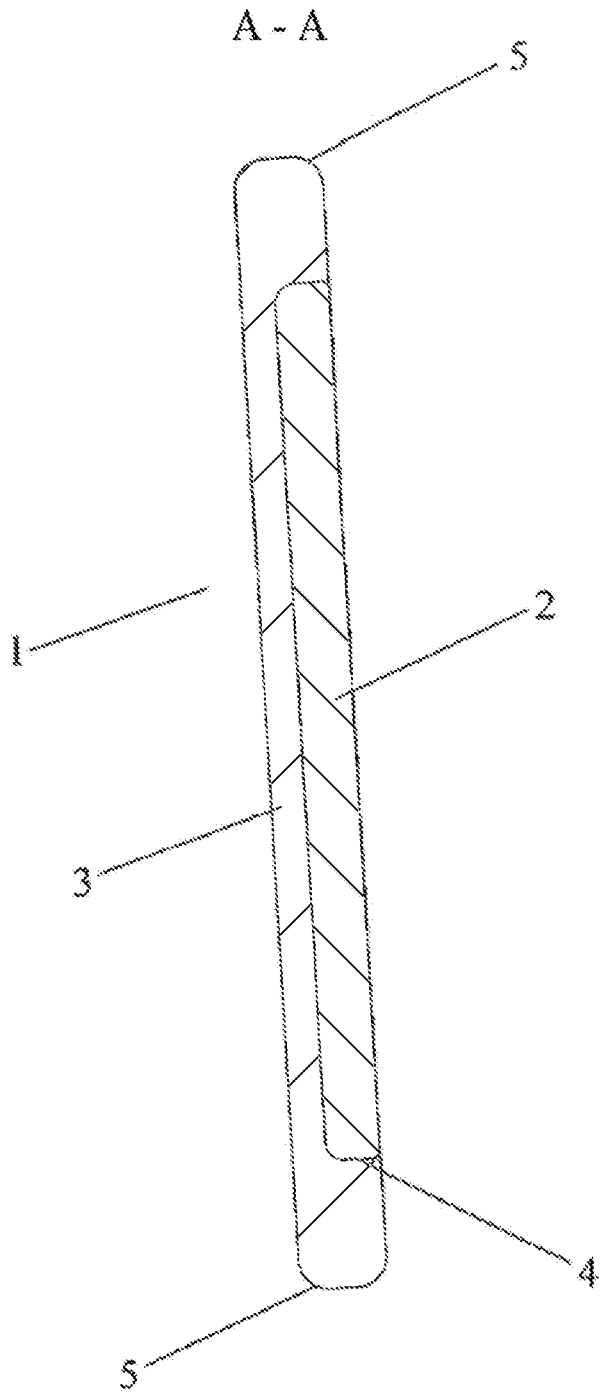
FIG. 3A to FIG. 3C are respective views of a cross section perpendicular to the direction of the arch of a fifth to seventh embodiment of the arched play element.
Figure 3B:
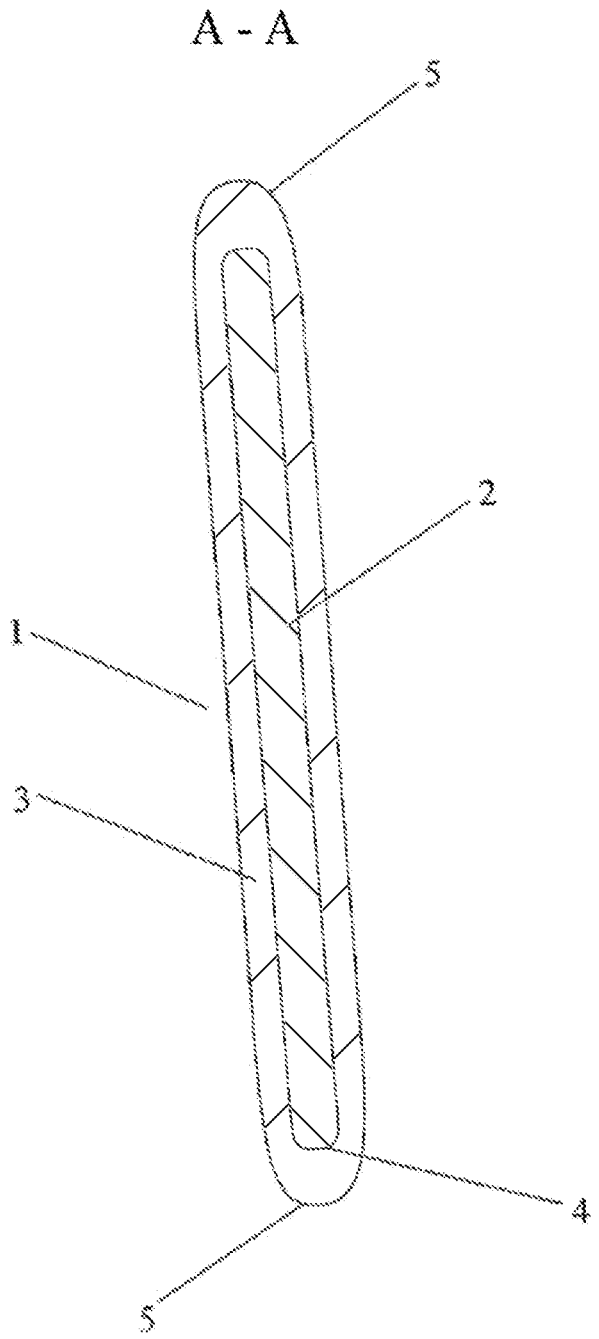
Figure 3C:
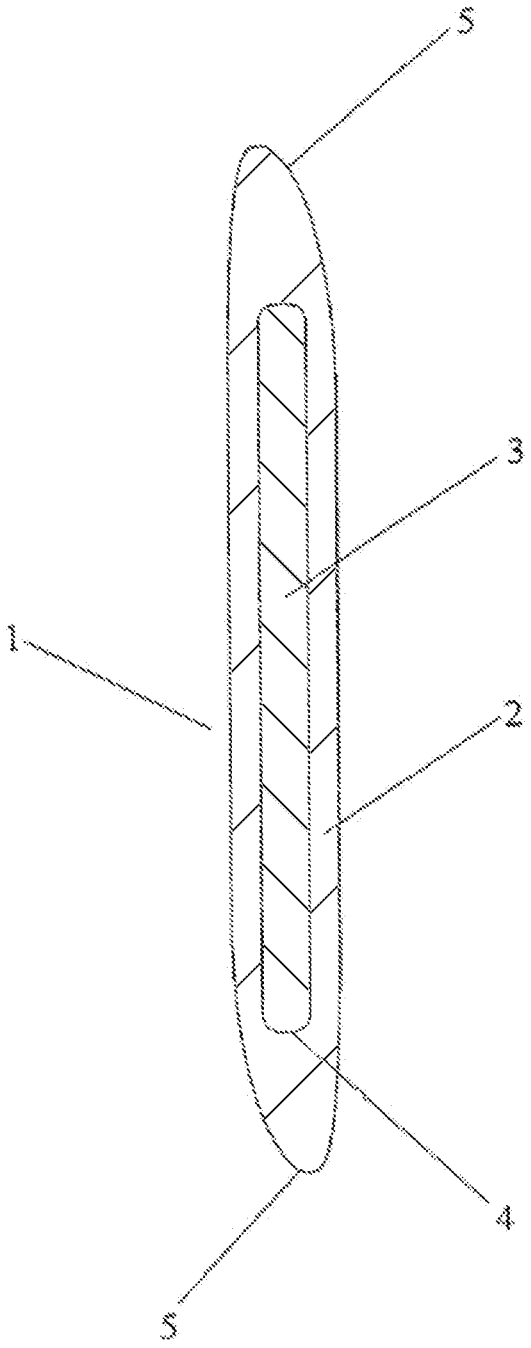

Additional embodiments of the play equipment according to the invention in the form of an arched play element 1 are indicated on FIG. 3A to FIG. 3C, which each show a view of a cross section perpendicular to the direction of the arch of the corresponding play element 1.

FIG. 3A shows a fifth embodiment of the arched play element 1, in which the arched inner surface and arched outer surface of the core element 2 along with the outer surface of the protective sheath 3, which in this embodiment does not cover the arched inner surface of the core element 2, are each uniformly conical in design.

FIG. 3B shows a sixth embodiment of the arched play element 1, whose ends are rounded and form the respective clamping and/or protection lip 5, in addition to which the arched inner surface and arched outer surface of the core element 2 are cylindrical, and the outer surface and inner surface of the protective sheath 3 have a correlating, uniformly conical design.

FIG. 3C shows a seventh embodiment of the arched play element 1, whose ends are here each mirror-inverted asymmetrically to each other to form the respective clamping and/or protection lip 5, in addition to which the arched inner surface and arched outer surface of the core element 2 along with the outer surface and inner surface of the protective sheath 3 have a correlating, uniformly conical design.

Figure 4A:
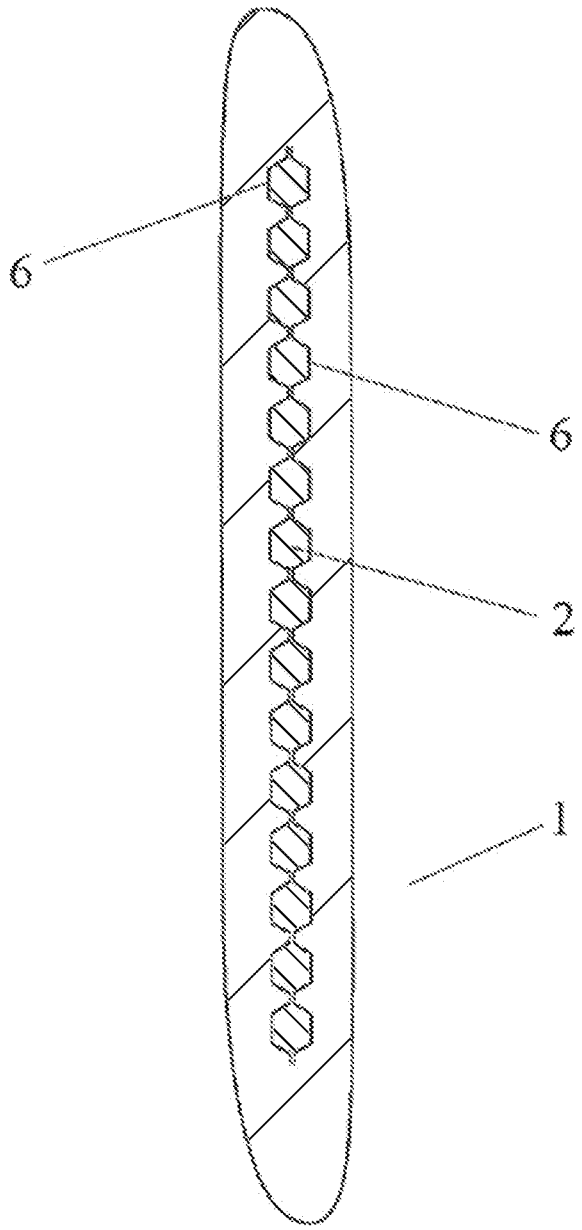
FIG. 4A to FIG. 4C are respective views of a section of an eighth to tenth embodiment of the play equipment according to the invention in the form of an arched play element, guided in the direction of the arch.

FIG. 4A shows a view of a section of an eighth embodiment of the arched play element 1 guided in the direction of the arch, wherein the arched core element 2 is comprised of two identical, ribbed thin shells 6 sandwiched together. The predominantly larger portion of the ribbing is here aligned in the direction of the arch, while the smaller portion of the ribbing is aligned transverse to the latter.

Figure 4B:
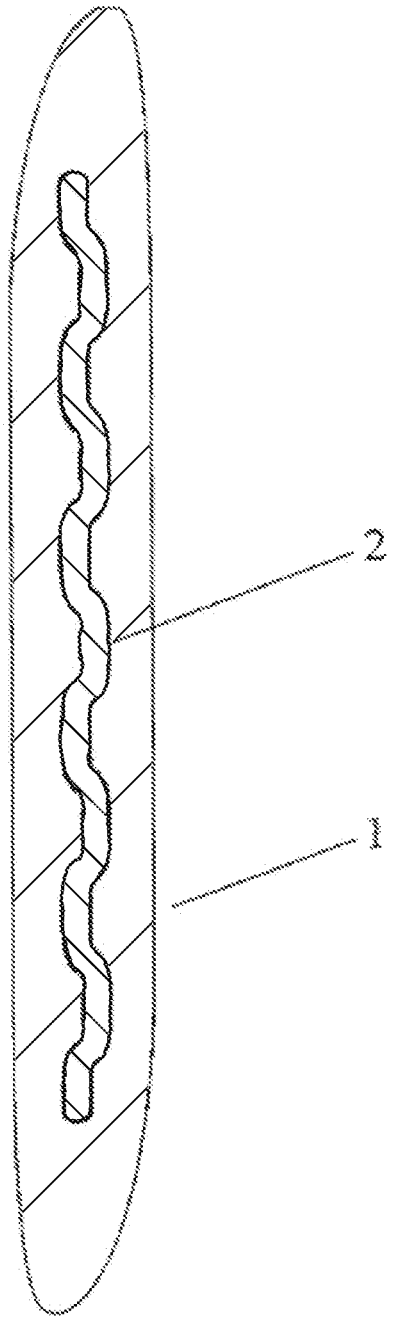

FIG. 4B shows a section of a ninth embodiment of the arched play element 1 corresponding to the one on FIG. 4A, whose outer contours correspond to those of the eighth embodiment, but the arched core element 2 has snakelike ribbing in the direction of the arch.

Figure 4C:
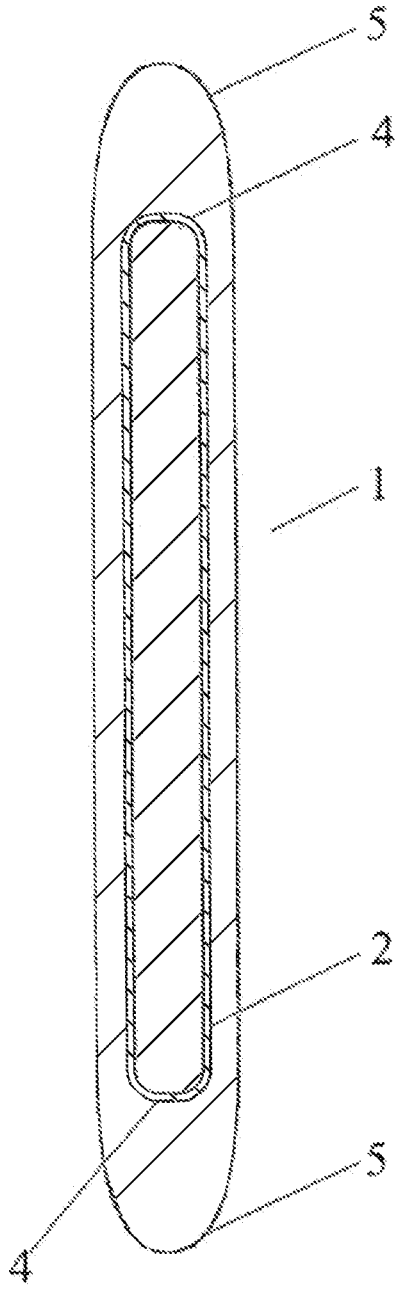

FIG. 4C shows a section of a tenth embodiment of the arched play element 1 corresponding to the one on FIG. 4A, but the arched core element 2 is designed like an undivided hollow container.

Figure 5A:
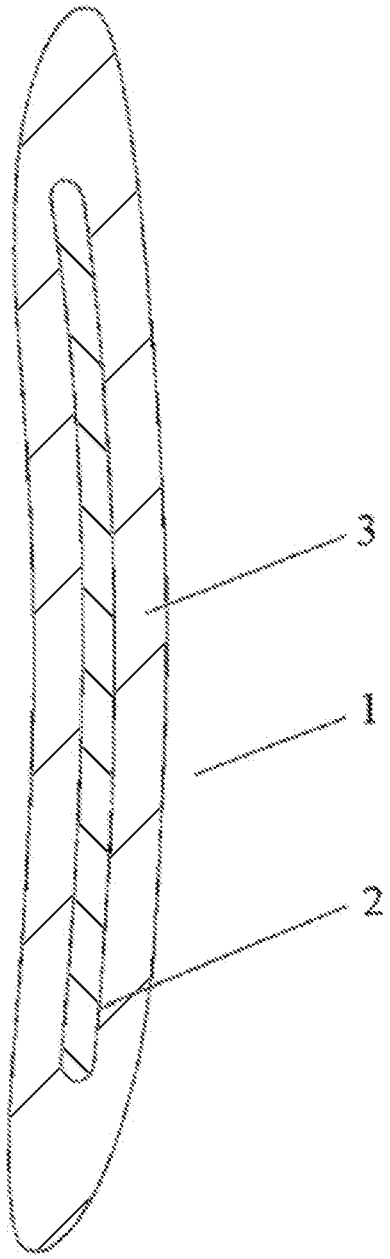
FIG. 5A and FIG. 5B are respective views of a cross section perpendicular to the direction of the arch of a thirteenth and fourteenth embodiment of the arched play element.
Figure 5B:
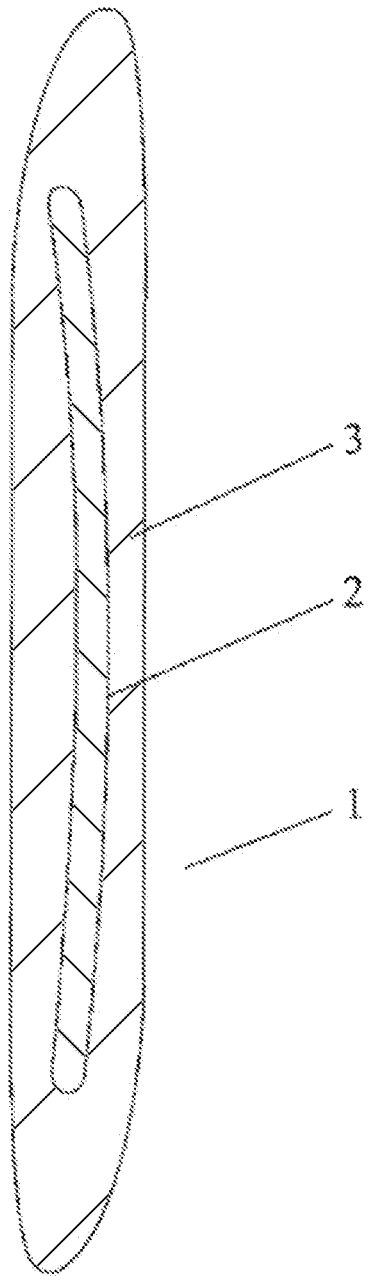

Further presented on FIG. 5A and FIG. 5B are views of a respective cross section perpendicular to the direction of the arch of an eleventh and twelfth embodiment of the arched play element 1, in which the respective flat core element 2 is also slightly bent in design perpendicular to the direction of the arch. In addition, the ends of the protective sheath 3 running in the direction of the arch are each mirror-inverted and symmetrically rounded in the eleventh and twelfth embodiments.

Figure 6A:
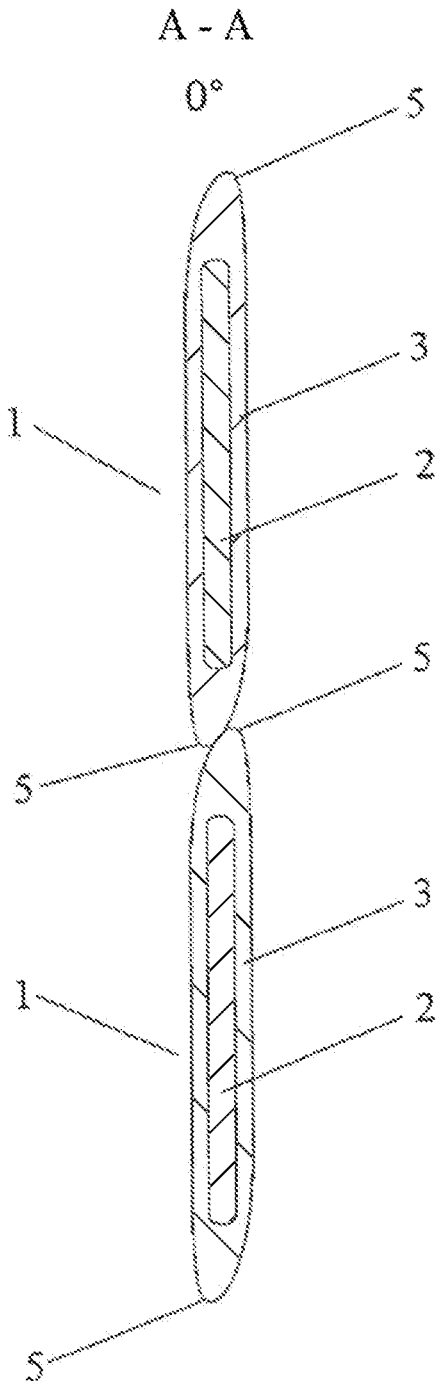
FIG. 6A is a view of a cross section perpendicular to the direction of the arch of two identical arched play elements stacked one on top of the other with mirror-inverted, asymmetrical clamping and/or protection lips at the two ends of each play element, wherein the outer surface and inner surface of the arched core element along with the outer surface and inner surface of the protective sheath fastened in contact with the protective sheath are identically partially cylindrical in design.

Presented on FIG. 6A is a view of a cross section perpendicular to the direction of the arch of two identical arched play elements 1 stacked one on top of the other with respectively mirror-inverted, asymmetrical clamping and/or protection lips 5 at the two ends of each play element 1, wherein the outer surface and inner surface of the arched core element 2 along with the outer surface and inner surface of the protective sheath 3 fastened in contact with the core element 2 are identically partially cylindrical in design.

Figure 6B:
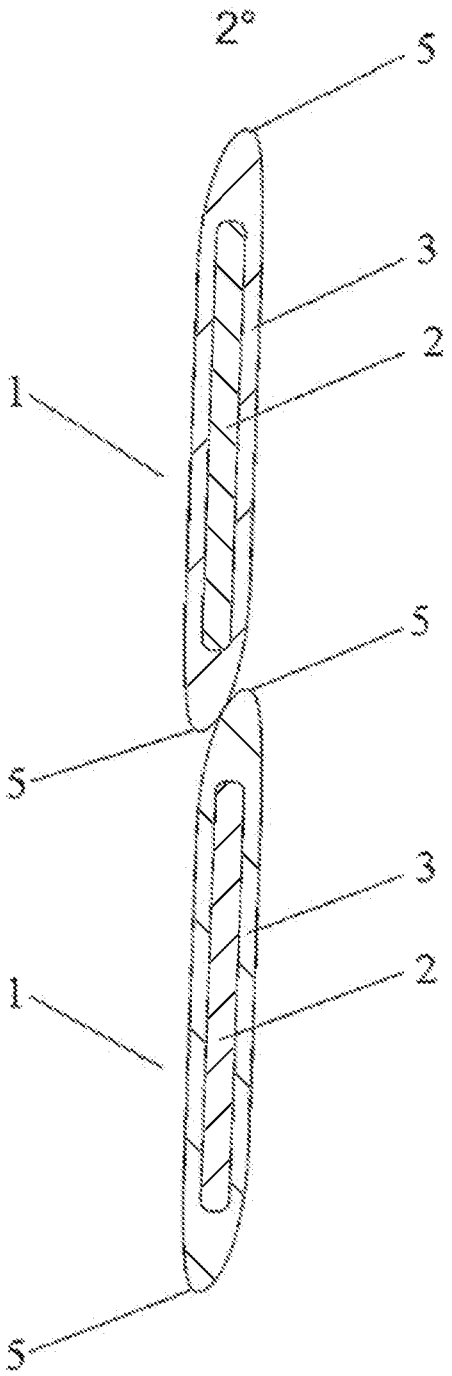
FIG. 6B is a view of a cross section perpendicular to the direction of the arch of two arched play elements stacked one on top of the other in a seventh embodiment.

FIG. 6B shows a view of a cross section corresponding to the one on FIG. 6A of two arched play elements 1 stacked one on top of the other of the seventh embodiment depicted on FIG. 3C, wherein the outer surface and inner surface of the arched core element 2 along with the outer surface and inner surface of the protective sheath 3 fastened in contact with the latter are uniformly conical in design at a cone angle of 2° to the vertical.

Figure 7:
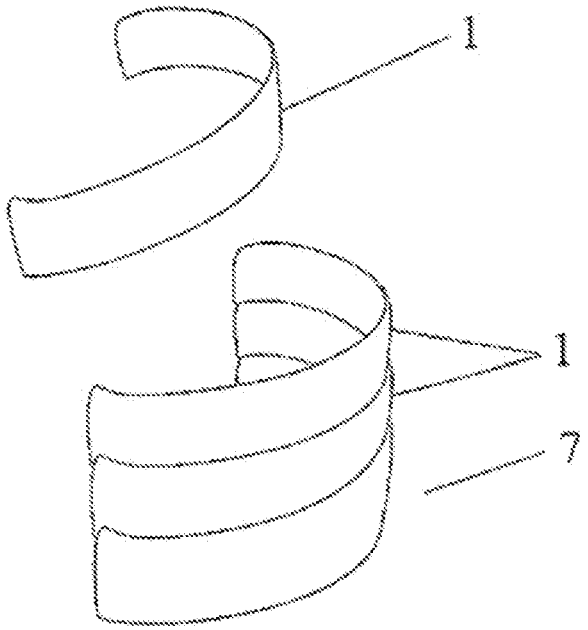
FIG. 7 is a perspective view—as seen at an inclination from above—of a play tower under construction with already four identical, arched play elements stacked one on top of the other, and a corresponding arched play element located in position above, whose core element has a respective uniformly conical configuration.

FIG. 7 is a perspective view—as seen at an inclination from above—of a play tower 7 under construction already with three identical, arched play elements 1 stacked one on top of the other and a corresponding fourth arched play element 1 located in position above, whose core elements 2 (not visible on FIG. 7) each have a respective uniformly conical configuration. Due to the uniform conical configuration of the core elements 2 of the play elements 1, a generally speaking partially cylindrical play structure in the form of the play tower is obtained by uniformly telescoping the arched play elements 1 while stacking them. As evident from FIG. 7, a centrally constant arch progression of the inner surface and outer surface is here provided for the arched play elements 1 stacked together in the as yet incomplete play tower 7.

Figure 8:
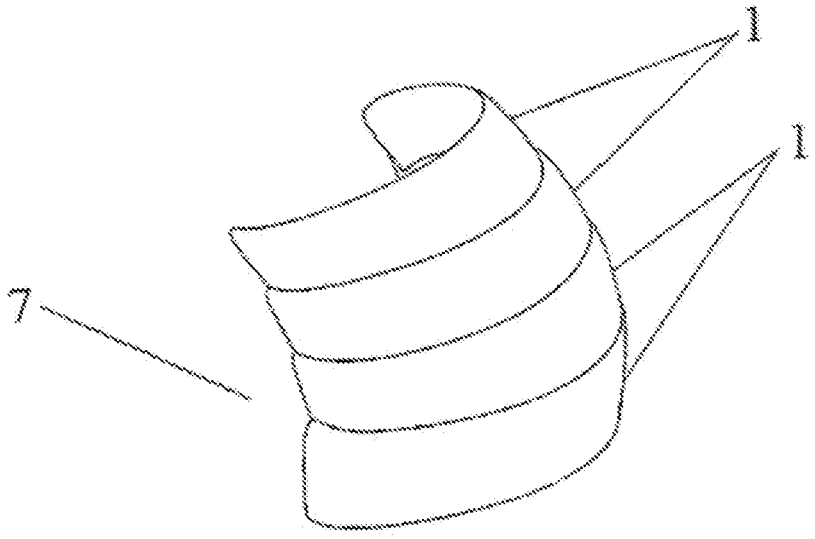
FIG. 8 is a perspective view—as seen at an inclination from above—of a play tower comprised of four identical arched play elements stacked one on top of the other, whose core element has a respective conical formation that rises toward its ends in the stacking direction.

FIG. 8 is a perspective view—as seen at an inclination from above—of a play tower 8 comprised of four identical, arched play elements 1 stacked one on top of the other, whose core elements 2 (not depicted on FIG. 8) have a respective conical formation that rises in the stacking direction toward their ends 4, so that uniformly telescoping the play elements 1 while stacking them yields the play tower 7 as an organically curved play structure. For example, when stacking five arched play elements 1, the stability of the play tower 8 is increased by shifting the center of gravity.

Figure 9:
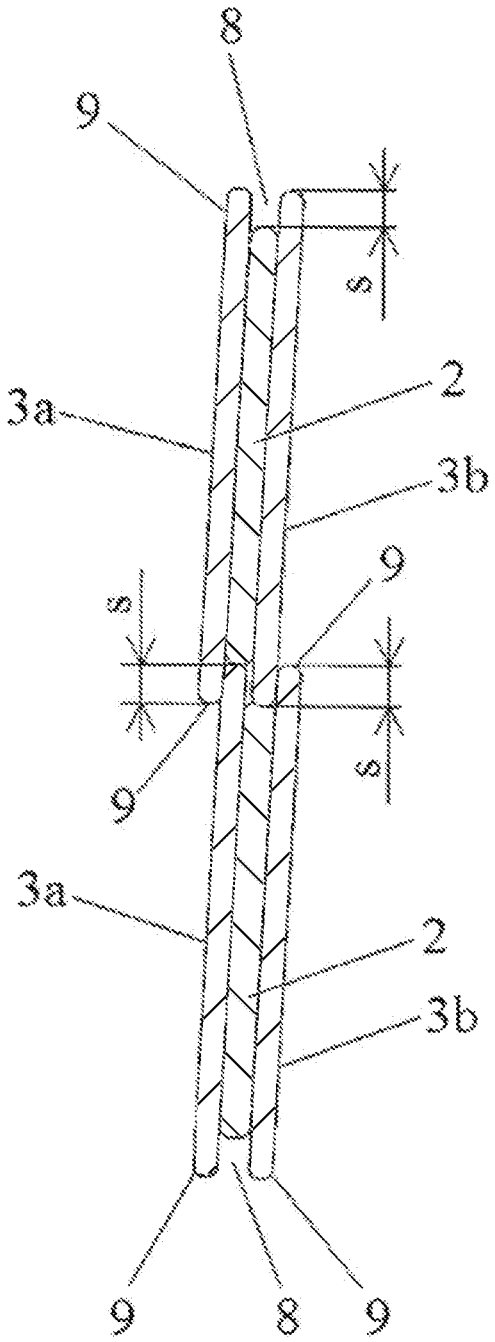
FIG. 9 is a view of a cross section through two play elements stacked one on top of the other of a fifteenth embodiment, in which a two-piece protective sheath is fastened in contact with the outer surface and inner surface.

FIG. 9 is a view of a cross section through two play elements of a thirteenth embodiment stacked one on top of the other, in which the protective sheath 3 consists of two pieces, such that a first protective sheath part 3*a* is fastened in contact with the outer surface, and a second protective sheath part 3*b* with the inner surface of the core element 2. The first protective sheath part 3*a* and second protective sheath part 3*b* each project for the same distance s over the—visible on FIG. 9—upper edge and lower edge of the core element 2, thereby yielding a respective groove 8, whose base is formed by the upper edge or lower edge of the core element 2, and whose width corresponds to the thickness of the core element 2. The section of the length s of the outer first protective sheath part 3*a* as well as of the inner second protective sheath part 3*b* that protrudes over the respective upper edge and lower edge of the core element 2 forms quasi support and protection lips 9 each lying on the outside and inside, and extend over the respective arch length of the play element 1. As shown on FIG. 9, when stacking two play elements 1 in this embodiment, the upper exterior support and protection lip 10 of the outer first protective sheath part 3*a* of the lower play element 1 in the stacking direction engages into the lower groove 9 of the upper play element 1 in the stacking direction, and comes to engage the lower edge of the corresponding core element 2, while the lower interior support and protection lip 9 of the inner second protective sheath part 3*b* of the upper play element in the stacking direction simultaneously engages into the upper groove 8 of the lower play element in the stacking direction, and comes to engage with the upper edge of the corresponding core element 2. This ensures a very stable and safe structure of a stable play tower 7, in particular as the play elements 1 alternatingly shift inward and outward.

Figure 10:
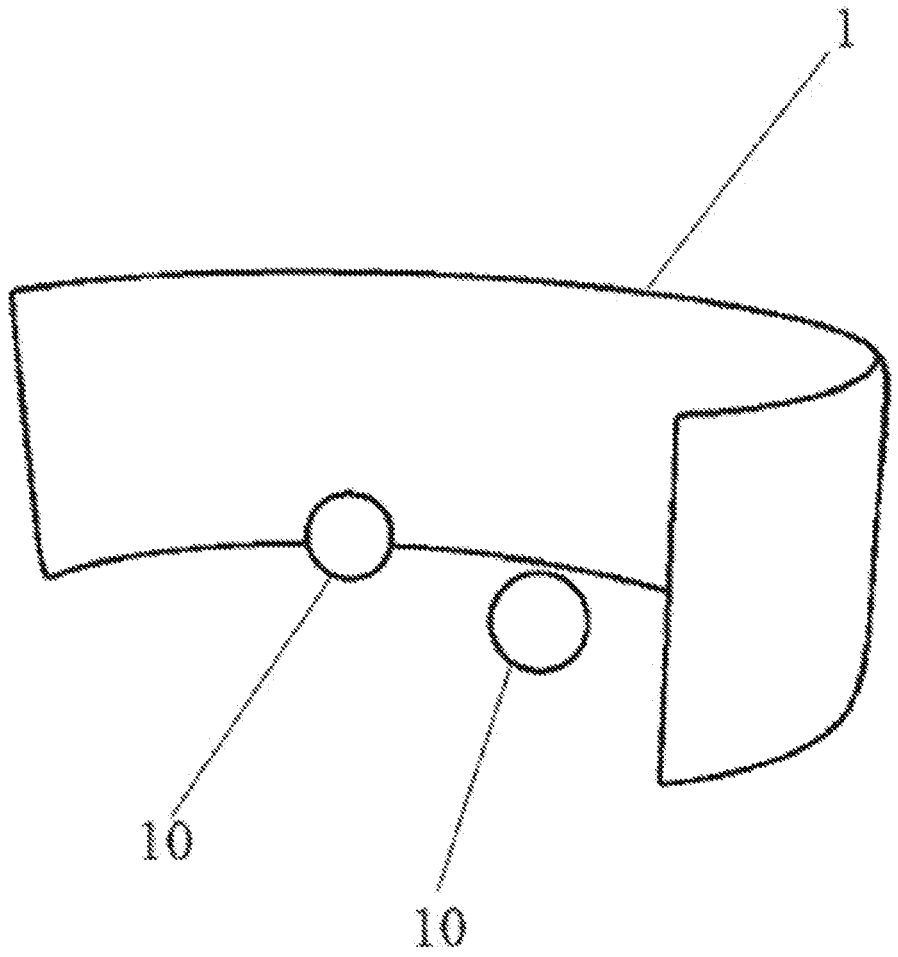
FIG. 10 is a side view of a schematic illustration of the arched play element as a ball-catching element.

FIG. 10 shows a schematic side view of the play equipment according to the invention in the form of the arched play element 1, which functions as a catching element for a ball 10.

Figure 11C:
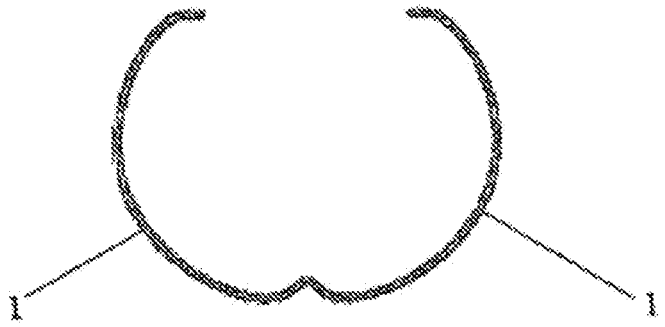
FIG. 11A to FIG. 11C are top views of schematically illustrated open play configurations, which each are to be comprised of a plurality of arched play elements.
Figure 11B:
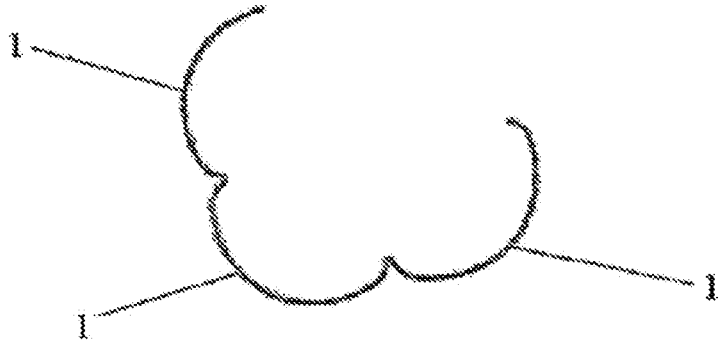
Figure 11A:
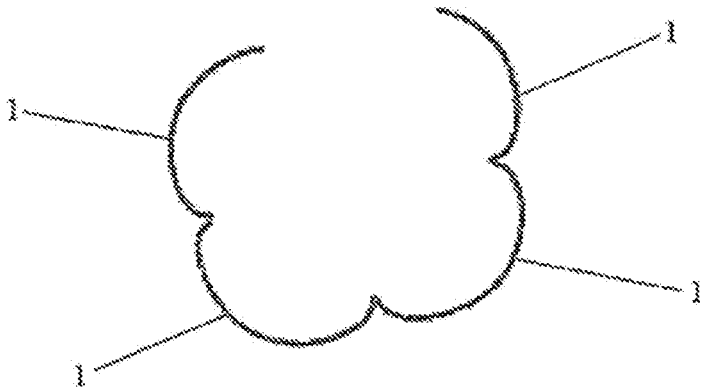

Finally, FIG. 11A to FIG. 11C present a top view of various possible layouts for play configurations to be variably comprised of several play elements 1, [which] can be open and/or closed and/or positioned into a play course.

REFERENCE LIST

1 Play element
2 Core element
3 Protective sheath
3*a* Outer protective sheath part
3*b* Inner protective sheath part
4 Ends of core element
5 Clamping and/or protection lips
6 Ribbed thin shells of core element
7 Play tower
8 Groove
9 Support and/or protection lips
10 Ball

The invention claimed is:

1. An arrangement comprising:

a first balancing element and a second balancing element, each balancing element comprising an arched structure comprising:

a core element which is arched, the core element comprising two end surfaces, an arched inner surface and an arched outer surface and two side surfaces, wherein the two end surfaces of the core element are inwardly directed to each other, and a protective sheath comprising a material which is soft and flexible, wherein the core element is embedded in the sheath so that the sheath protrudes beyond both side surfaces of the arched core element along the arch, wherein the sheath protrudes beyond the two end surfaces of the core element, wherein the sheath protrudes beyond the arched inner surface of the core element as well as the arched outer surface of the core element, and wherein an arched outer surface of the sheath, an arched inner surface of the sheath, the arched outer surface of the core element and the arched inner surface of the core element are slanted, wherein two opposite first and second buffers are formed along the arch of the first balancing element and two opposite third and fourth buffers are formed along the arch of the second balancing element, wherein an outer surface of the second buffer of the first balancing element is clamped with an inner surface of the third buffer of the second balancing element, wherein the second balancing element is stacked on top of the first balancing element, and wherein the first and second buffers are point symmetrical and not mirror symmetric and the third and fourth buffers are point symmetrical and not mirror symmetric.

2. The arrangement according to claim 1, wherein the arched outer surface of the sheath, the arched inner surface of the sheath, the arched outer surface of the core element and the arched inner surface of the core element are arranged parallel to one another.

3. The arrangement according to claim 1, wherein the sheath of each balancing element protrudes beyond the side surfaces of the core element in a rounded manner in order to form the buffers.

4. The arrangement according to claim 1, wherein the arched core element of each balancing element is partially hollow.

5. The arrangement according to claim 1, wherein the protective sheath of each balancing element is made out of a washable material, or the protective sheath is made out of an integral foam.

6. The arrangement according to claim 1, wherein a radius of the arched shape of the core element of each balancing element ranges from 40 to 120 centimeters.

7. The arrangement according to claim 1, wherein each of the two opposite buffers of each balancing element has a width ranging from 5 cm to 9 cm.

* * * * *